US008388183B2

(12) United States Patent
Miki et al.

(10) Patent No.: US 8,388,183 B2
(45) Date of Patent: Mar. 5, 2013

(54) LIGHTING APPARATUS AND LAMP HAVING A PROTRUSION ON AN OUTER SURFACE OF AN INNER CASING ABUTTING AN INNER SURFACE OF AN OUTER CASING THEREOF

(75) Inventors: Masahiro Miki, Osaka (JP); Takaari Uemoto, Osaka (JP); Hideo Nagai, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/393,084

(22) PCT Filed: Feb. 10, 2011

(86) PCT No.: PCT/JP2011/000743

§ 371 (c)(1),
(2), (4) Date: Feb. 28, 2012

(87) PCT Pub. No.: WO2011/148536

PCT Pub. Date: Dec. 1, 2011

(65) Prior Publication Data

US 2012/0161630 A1 Jun. 28, 2012

(30) Foreign Application Priority Data

May 24, 2010 (JP) ..... 2010-118838

(51) Int. Cl.
*F21S 4/00* (2006.01)

(52) U.S. Cl. ..... 362/249.02; 362/362

(58) Field of Classification Search ..... 362/249.01, 362/249.02, 257, 362, 375, 448, 800
See application file for complete search history.

(56) References Cited

U.S. PATENT DOCUMENTS

| | | | | |
|---|---|---|---|---|
| 7,484,860 | B2 * | 2/2009 | Demarest et al. | 362/253 |
| 7,758,223 | B2 * | 7/2010 | Osawa et al. | 362/547 |
| 2010/0096992 | A1 | 4/2010 | Yamamoto et al. | |
| 2010/0219735 | A1 * | 9/2010 | Sakai et al. | 313/46 |
| 2010/0237779 | A1 * | 9/2010 | Osawa et al. | 315/32 |
| 2010/0244694 | A1 * | 9/2010 | Osawa et al. | 315/32 |

FOREIGN PATENT DOCUMENTS

| | | |
|---|---|---|
| JP | 3014850 | 6/1995 |
| JP | 2009-4130 | 1/2009 |
| JP | 2009-037995 | 2/2009 |
| JP | 2009-267082 | 11/2009 |
| WO | 2008/146694 | 12/2008 |

* cited by examiner

*Primary Examiner* — Thuy Vinh Tran
(74) *Attorney, Agent, or Firm* — Greenblum & Bernstein, P.L.C.

(57) ABSTRACT

A lamp capable of effectively suppressing increase in the temperature of circuit devices is provided. The lamp includes: an LED module composed of LED chips; a base through which electric power is received; a lighting circuit which includes a circuit device group for generating electric power for causing the LED module to emit light using the electric power received through the base; an inner casing which is a tubular portion made of resin for housing the lighting circuit; and an outer casing which is a tubular portion for housing the inner casing. On the circumferential surface of the inner casing, a protrusion is provided which directly abuts the inner circumferential surface of the outer casing.

16 Claims, 13 Drawing Sheets

PRIOR ART

PRIOR ART

LIGHTING APPARATUS AND LAMP HAVING A PROTRUSION ON AN OUTER SURFACE OF AN INNER CASING ABUTTING AN INNER SURFACE OF AN OUTER CASING THEREOF

TECHNICAL FIELD

The present invention relates to lamps and lighting apparatuses, and particularly relates to a lamp and a lighting apparatus using a semiconductor light-emitting device.

BACKGROUND ART

In recent years, semiconductor light-emitting devices such as Light-emitting Diodes (LEDs) have been attracting attention as new light sources for lamps which can contribute to the prevention of global warming by saving energy because such LEDs provide a higher energy efficiency and have a longer product life than incandescent lamps and halogen lamps. Research and development on such LED lamps using LEDs as light sources is in progress.

It is known that optical output of an LED decreases and the product life becomes shorter as the temperature of the LED increases. For this reason, it is necessary for such an LED lamp to have an efficient heat transfer structure in order to suppress increase in the temperature. In view of this, various kinds of LED lamps having an efficient heat transfer structure have been conventionally proposed (for example, see Patent Literatures 1 to 3).

FIG. 12 and FIG. 13 are a cross sectional view and an exploded perspective view of a conventional LED lamp disclosed in Patent Literature 1, respectively. As shown in FIG. 12, in this conventional LED lamp, a through hole 228 and a first groove 232 allow communication between the circumferential part of an LED device 236 and the outside of the LED bulb 210. Thus, heat generated by the LED device 236 is transferred to the outside via the through hole 228 and the first groove 232.

On the other hand, Patent Literature 2 discloses a technique for suppressing increase in the temperature in an LED by providing a metal holder formed by integrating a circumferential side surface part which is exposed to the outside and a light source attachment part.

Further, Patent Literature 3 discloses forming a fin for increasing a heat transfer effect on the outer circumferential surface of an LED lamp.

CITATION LIST

Patent Literature

[PTL 1]
Japanese Unexamined Patent Application Publication No. 2009-267082
[PTL 2]
Japanese Unexamined Patent Application Publication No. 2009-037995
[PTL 3]
Japanese Unexamined Patent Application Publication No. 2009-004130

SUMMARY OF INVENTION

Technical Problem

An LED lamp includes a lighting circuit for causing the LED to emit light, and is required to suppress increase in the temperatures of the LED and the lighting circuit (more specifically, a circuit device which constitutes the lighting circuit).

This is because the circuit device consumes approximately 20 percent of the electric power supplied to the LED lamp, and an increase in the temperature of the circuit device increases energy loss (circuit loss) in the circuit device. Accordingly, it is also important to suppress increase in the temperature of the circuit device in order to save energy consumed by the LED lamp.

However, none of the aforementioned conventional LED lamps does not exert any sufficient heat transfer measure for its circuit device. For this reason, each of the conventional LED lamps has a problem of being incapable of sufficiently transferring heat generated in the circuit device to the outside of the lamp when the LED emits light and thus is incapable of suppressing increase in the temperature of the circuit device.

At first glance, the LED lamp disclosed in Patent Literature 1 shown in FIG. 13 seems to be capable of transferring heat generated by an electric component 256 via an inner body 258 which covers the electric component 256 and a convex portion 274 which is provided on the outer circumferential surface. However, in this LED lamp, the inner body 258 is fit into the inside of a tubular portion 214 such that a major diameter part 260 covers the electric component 256, and the inner body 258 is fit with the outer body 212 such that the convex portion 274 is provided along a second groove (inner-body fixed groove) 234 formed on an inner surface of the tubular portion 214. For this reason, the inner body 258 and the outer body 212 are not closely in contact with each other. Thus, heat generated by the electric component 256 is not sufficiently conducted to the outer body 212.

When the temperature of a circuit device cannot be suppressed as in such cases, circuit loss caused by the circuit device decreases the energy efficiency. As a result, the product life of the circuit device is significantly shortened.

The present invention has been made to solve such a problem with an aim to provide a lamp and a lighting apparatus which are capable of efficiently suppressing increase in the temperatures of their circuit devices.

Solution to Problem

In order to solve the problem, a ramp according to an aspect of the present invention is a ramp comprising: a light source including a semiconductor light-emitting device; a base through which electric power is received; a lighting circuit including a circuit device which generates electric power for causing the light source to emit light, using the electric power received through the base; an inner casing which is a tubular portion made of resin for housing the lighting circuit; and an outer casing which is a tubular portion for housing the inner casing, wherein a protrusion is provided on an outer circumferential surface of the inner casing, the protrusion directly abutting an inner circumferential surface of the outer casing.

In this way, the protrusion is provided on the outer circumferential surface of the inner casing to abut the inner circumferential surface of the outer casing. Thus, the heat generated by the circuit device is securely conducted from the inner casing to the outer casing via the protrusion and is transferred to the outside.

Here, "the protrusion which directly abuts the inner circumferential surface of the outer casing" means that the protrusion is directly in contact, at its end, with the inner circumferential surface of the outer casing without being directly or indirectly in contact with any other structural element such as the second groove (inner-body fixed groove) 234 formed on the inner surface of the tubular portion 214 in Patent Literature 1. Here, it is only necessary that at least "the protrusion which directly abuts the inner circumferential surface of the outer casing" is provided on the outer circumferential surface of the inner casing of the lamp according to the present invention. Naturally, it is also possible to further provide any other protrusion (a protrusion which is in contact with another element). Furthermore, the protrusion may abut the inner circumferential surface of the outer casing in a state where the end portion is transformed. The protrusion is in contact, at its end portion, with the inner surface of the outer casing in the state where the end portion is transformed with power strong enough to transform the end portion. Thus, it is possible to increase the closeness between the inner casing and the outer casing, and to thereby increase the heat conduction efficiency. In addition, it is possible to reduce size differences between the components of the inner casing and the outer casing by transforming the protrusion even when the components have some size differences.

Here, the protrusion may have a linear structure extending in a circumferential direction of the outer circumferential surface of the inner casing. At this time, the protrusion should preferably have a plurality of linear portions each having the linear structure. This is because the linear portions increase the heat transfer effect.

In addition, the linear portions may be arranged, at a certain interval, on a circumference on the outer circumferential surface of the inner casing. Since the linear portions are arranged at a constant interval in this way, a gap is secured between adjacent ones of the linear portions. This prevents the space enclosed by the outer circumferential surface of the inner casing and the inner circumferential surface of the outer casing from being sealed by the linear portions, and secures air convection in the space. Thereby, it is possible to prevent a local increase in the temperature of the lamp.

In addition, the linear portions may be provided on mutually different circumferences on the outer circumferential surface of the inner casing. For example, the inner casing may include a first opening which is open toward the light source and a second opening which is positioned opposite to the first opening, and the linear portions may include: a linear portion which is provided on a circumference that is closer to the second opening than to the first opening on the outer circumferential surface of the inner casing; and a linear portion which is provided on a circumference that is closer to the first opening than to the second opening on the outer circumferential surface of the inner casing. In this way, the linear portions provided at the positions in the axis direction of the outer circumferential surface of the inner casing fix, to have a certain distance, the outer circumferential surface of the inner casing and the inner circumferential surface of the outer casing. These linear portions increase the strength in the temporal fixing of the inner casing in the outer casing when the lamp components are assembled, increasing operability in the assembly process.

Here, the "axis direction" is a direction that is parallel or approximately parallel to the rotation axis when the lamp is seen as a rotation body.

In addition, at least one of the linear portions may be provided along an entire circumference on the outer circumferential surface of the inner casing. In this way, it is possible to securely conduct the heat generated by the circuit device via the protrusion irrespective of the position of the inner casing in the circumferential direction on the outer circumferential surface.

Here, the protrusion may include a linear structure extending in an axis direction of the tubular portion in the outer circumferential surface of the inner casing. At this time, the protrusion should preferably have a plurality of linear portions each having the linear structure. In this way, the linear portions provided at the positions in the axis direction of the outer circumferential surface of the inner casing increase the heat transfer effect and fix, to have a certain distance, the outer circumferential surface of the inner casing and the inner circumferential surface of the outer casing. Thus, these linear portions increase the strength in the temporal fixing of the inner casing in the outer casing when the lamp components are assembled, increasing operability in the assembly process.

In addition, the protrusion may include a plurality of columnar portions each having a columnar structure which protrudes out from the outer circumferential surface of the inner casing toward an inner circumferential surface of the outer casing. At this time, the columnar portions should preferably be arranged on a circumference on the outer circumferential surface of the inner casing. In this way, the linear portions provided at the positions in the axis direction of the outer circumferential surface of the inner casing increase the heat transfer effect and fix, to have a certain distance, the outer circumferential surface of the inner casing and the inner circumferential surface of the outer casing. Thus, these linear portions increase the strength in the temporal fixing of the inner casing in the outer casing when the lamp components are assembled, increasing operability in the assembly process.

In addition, the protrusion should preferably be provided at least in an area which covers the circuit device and is on the outer circumferential surface of the inner casing. In this way, the protrusion is provided at a position close to the circuit device which generates heat. This increases the heat transfer effect. Here, the "area which covers the circuit element on the outer circumferential surface of the inner casing" means an area which is of the outer circumferential surface of the inner casing and inside of which the circuit device is present in the axis direction.

In addition, the protrusion may be formed integrally with the inner casing. In this way, the protrusion is formed integrally with the inner casing by using a metal frame when manufacturing the inner casing. This prevents increase in the number of components and in the number of man hours required for the assembly process.

In contrast, the protrusion may be formed independently from the inner casing. For example, the protrusion may have a circular structure which encloses the entire one of the circumferences on the outer circumferential surface of the inner casing and may function as the protrusion of the inner casing when the protrusion is fit into the inner casing. In this way, it is possible to modify a conventional lamp having an inner casing without any protrusion into a lamp having an excellent heat transfer effect according to the present invention by adding a protrusion independent from the inner casing to the conventional lamp.

In addition, the protrusion may be formed by cutting a part of the side surface of the inner casing and turning up the part outward. In this case, the protrusion generated by cutting and turning up outward the part of the inner casing becomes in contact with the inner circumferential surface of the outer casing, increasing the closeness and the heat transfer effect. Furthermore, the protrusion increases the strength of the temporal fixing of the inner casing inside the outer casing in the assembly process, increasing the operability in the assembly process.

Furthermore, the present invention can be implemented not only as a lamp but also as a lighting apparatus including the lamp and a lighting tool etc. which supports the lamp.

Advantageous Effects of Invention

A protrusion provided on the outer circumferential surface of the inner casing is directly in contact with the inner circumferential surface of the outer casing, which increases the contact area between the inner casing and the outer casing. The protrusion increases the heat transfer effect to the heat generated by a circuit device, protects the circuit device from the heat, and thereby allows the light source to exert a desired effect.

Figure 4:
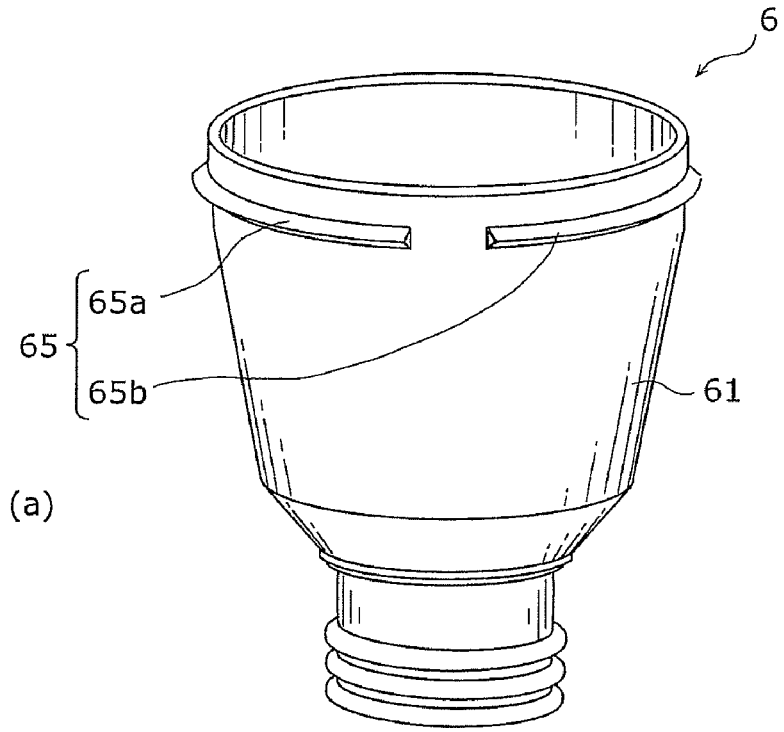
Figure 4:
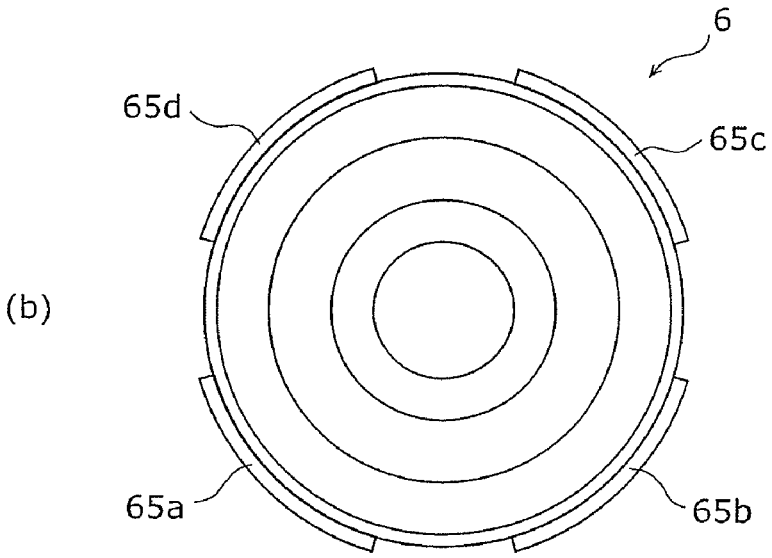

(a) of FIG. 4 is a perspective view of an inner casing included in the lamp according to the embodiment of the present invention. (b) of FIG. 4 is a plan view of the inner casing when seen from the side of an LED module.

Figure 5:
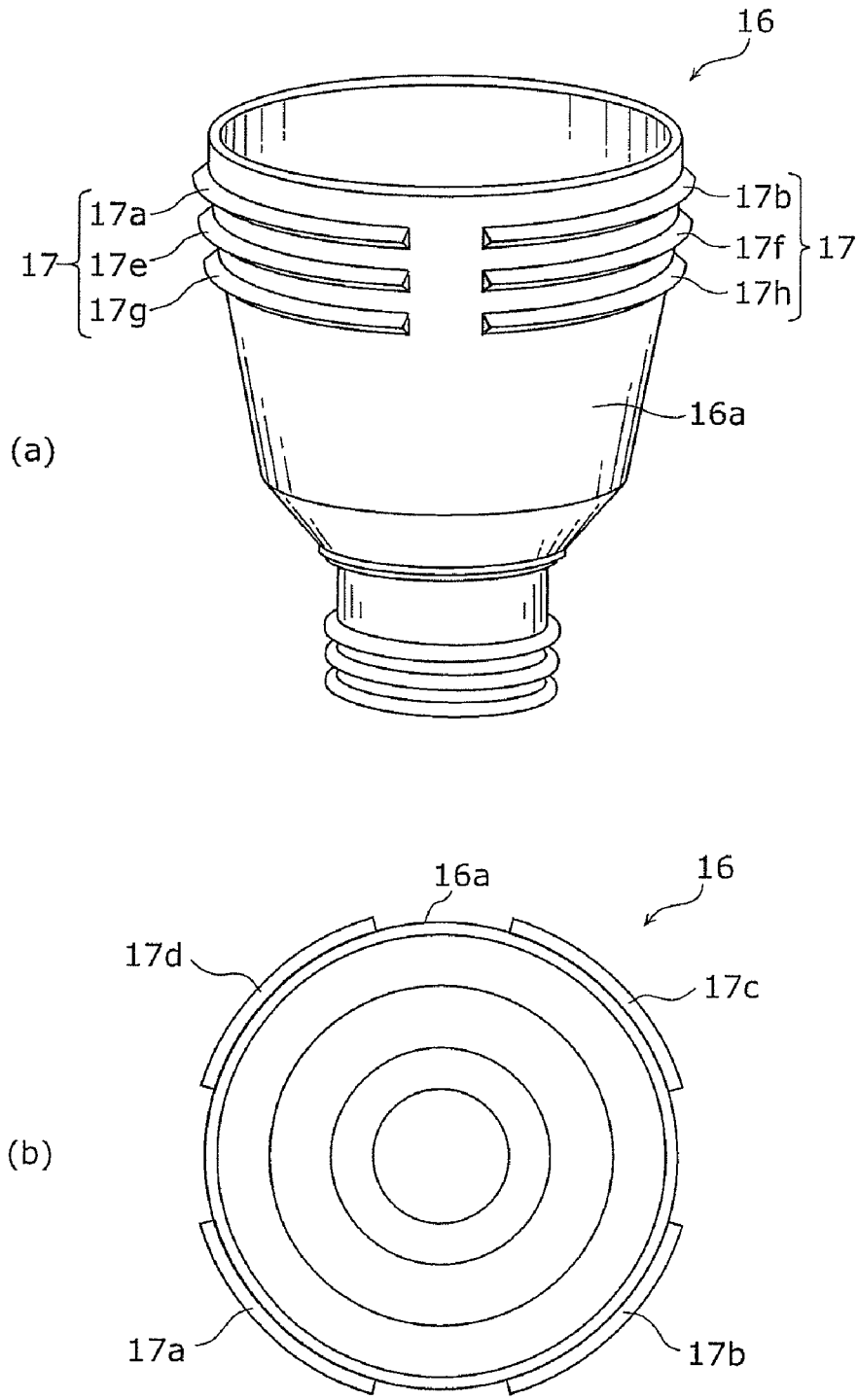

(a) of FIG. 5 is a perspective view of an inner casing according to Variation 1 in the present invention. (b) of FIG. 5 is a plan view of the inner casing when seen from the side of an LED module.

Figure 6:
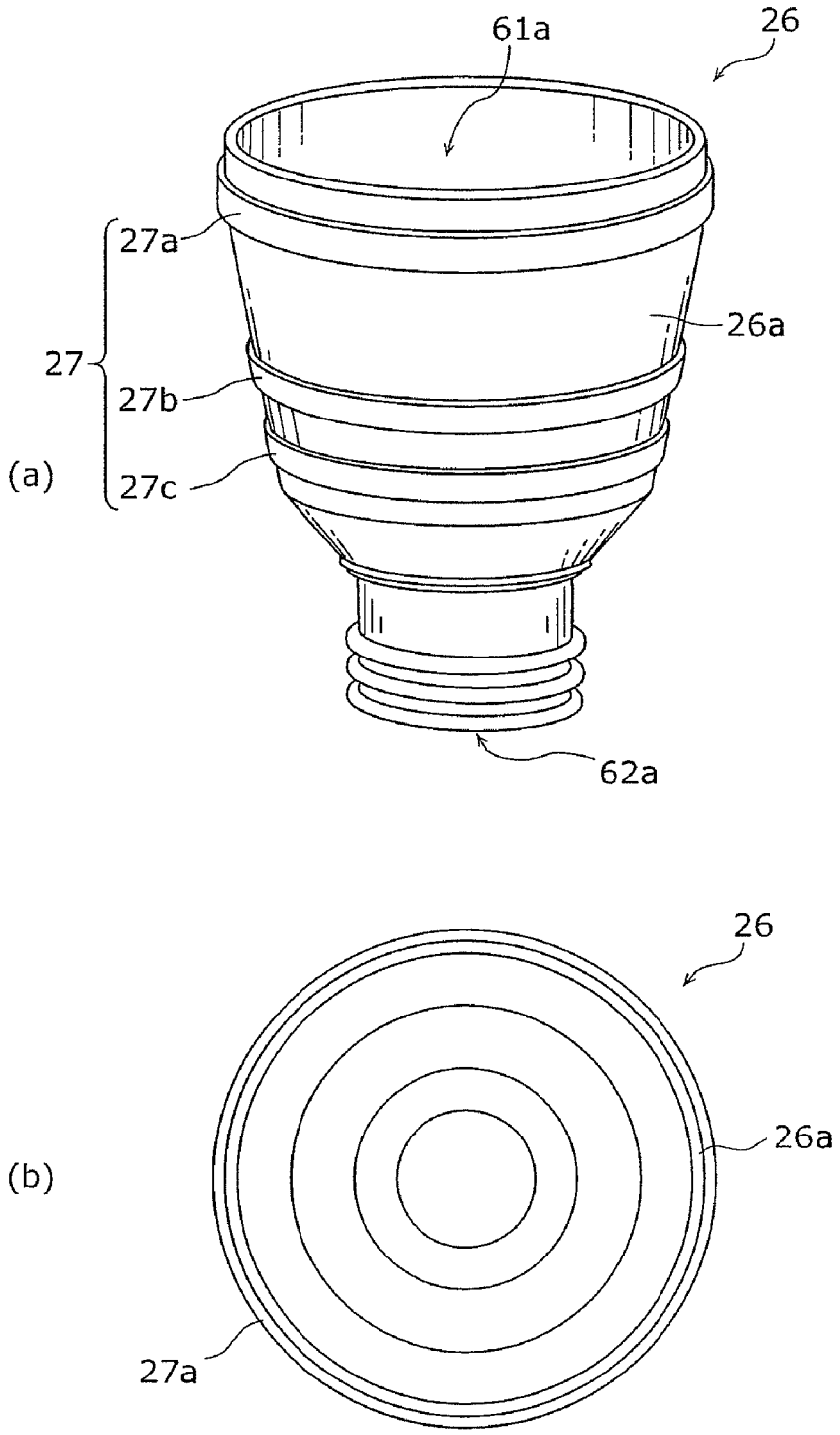

(a) of FIG. 6 is a perspective view of an inner casing according to Variation 2 in the present invention. (b) of FIG. 6 is a plan view of the inner casing when seen from the side of an LED module.

Figure 7:
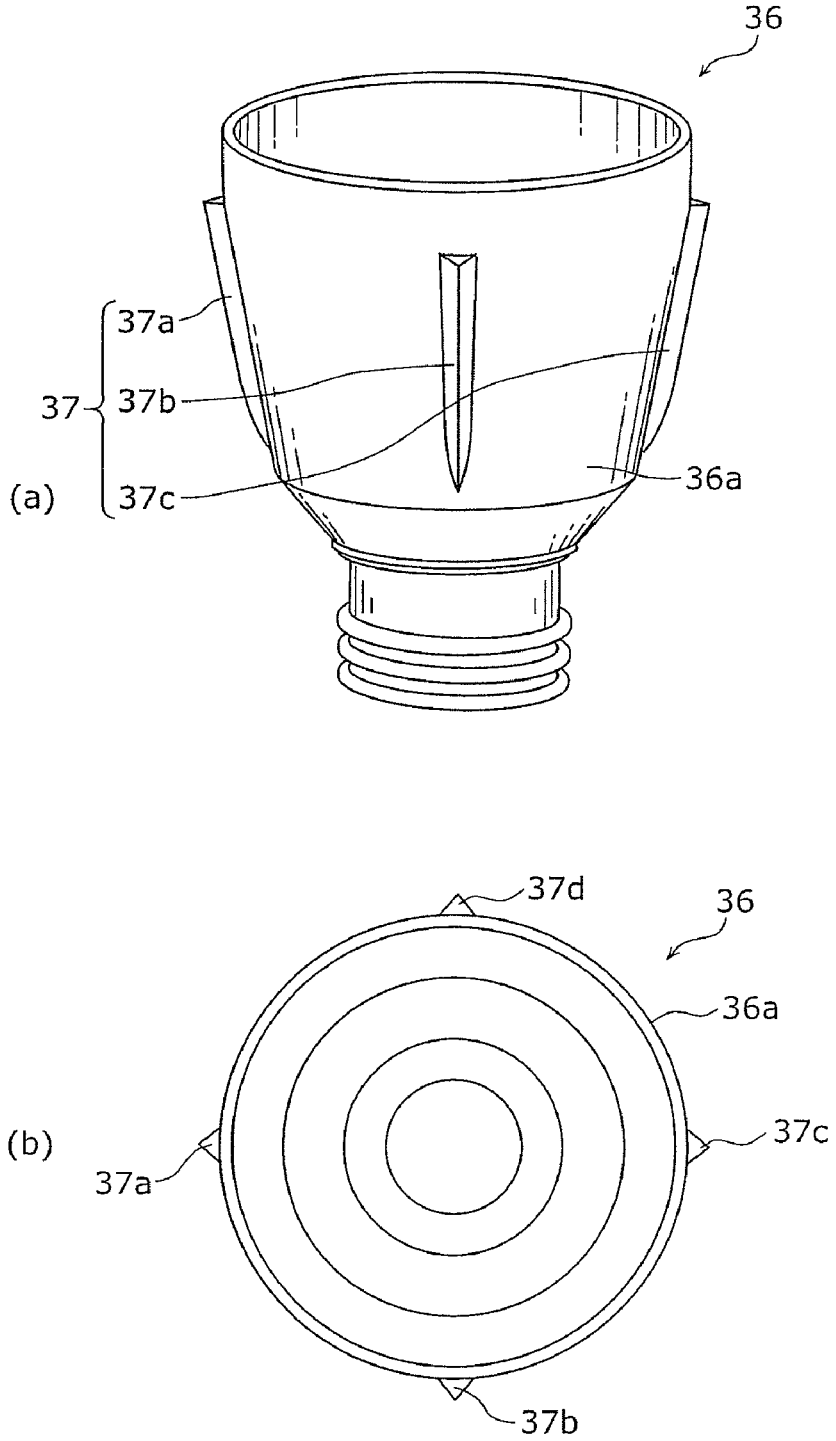

(a) of FIG. 7 is a perspective view of an inner casing according to Variation 3 in the present invention. (b) of FIG. 7 is a plan view of the inner casing when seen from the side of an LED module.

Figure 8:
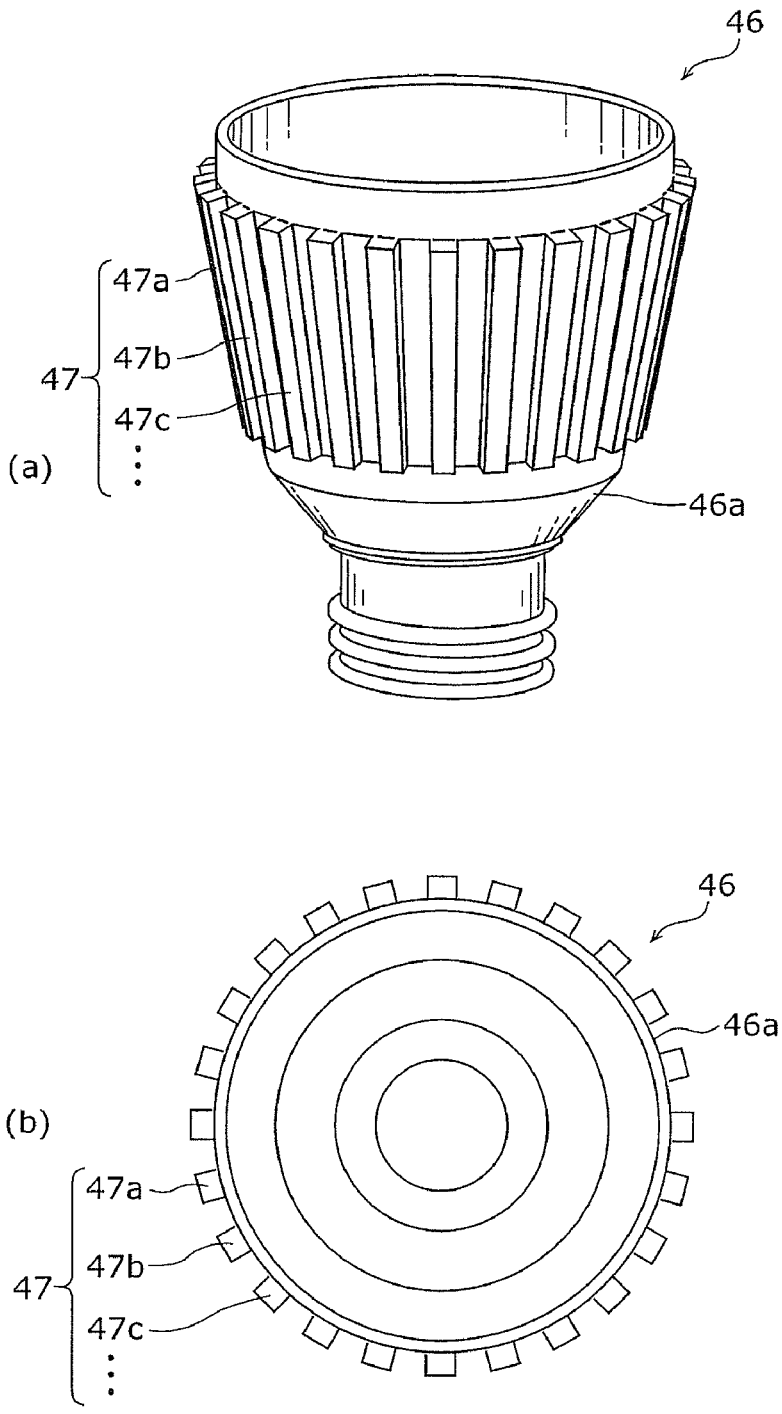

(a) of FIG. 8 is a perspective view of an inner casing according to Variation 4 in the present invention. (b) of FIG. 8 is a plan view of the inner casing when seen from the side of an LED module.

Figure 9:
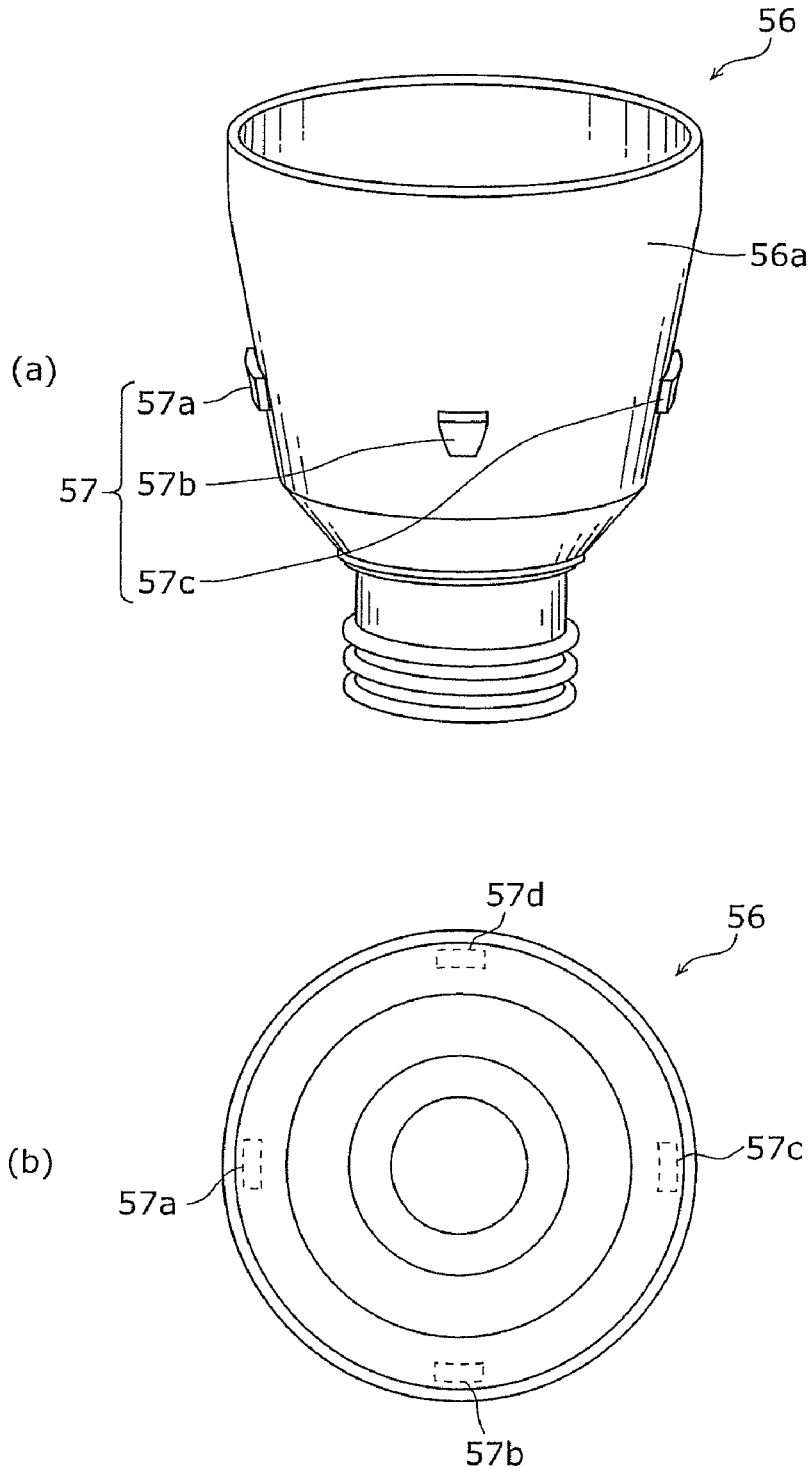

(a) of FIG. 9 is a perspective view of an inner casing according to Variation 5 in the present invention. (b) of FIG. 9 is a plan view of the inner casing when seen from the side of an LED module.

Figure 10:
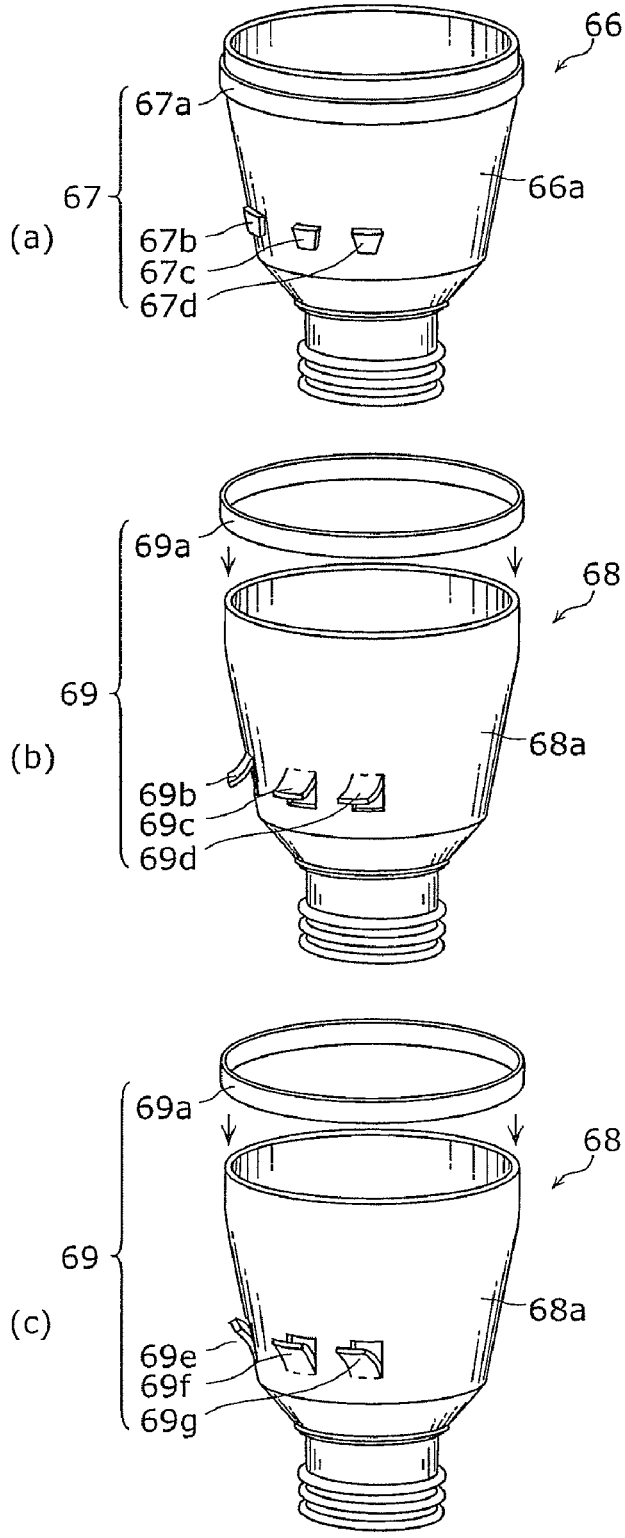

Each of (a) to (c) of FIG. 10 is a perspective view of an inner casing according to another variation in the present invention.

Figure 11:
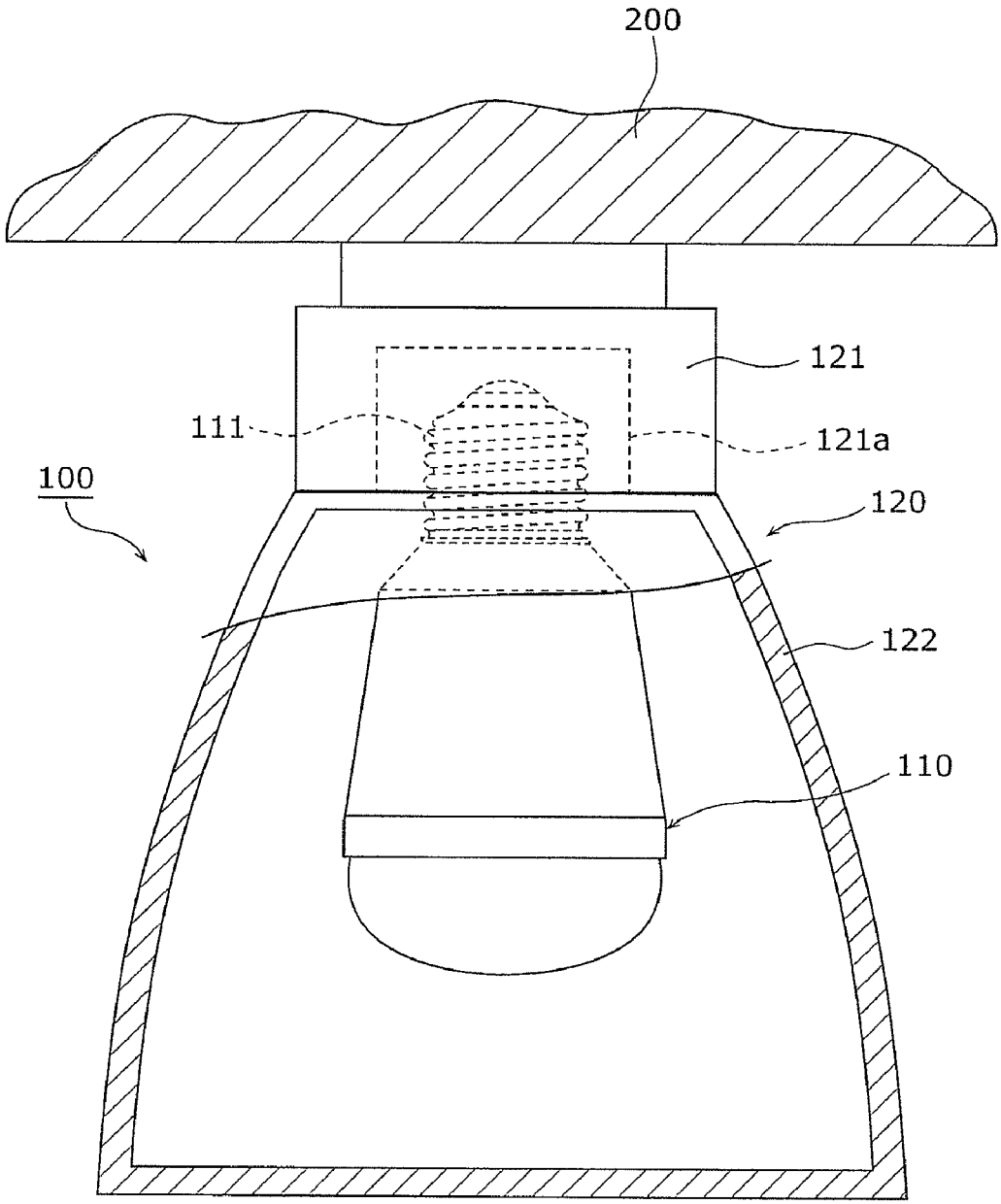

FIG. 11 is a schematic cross sectional view of a lighting apparatus according to the present invention.

Figure 12:
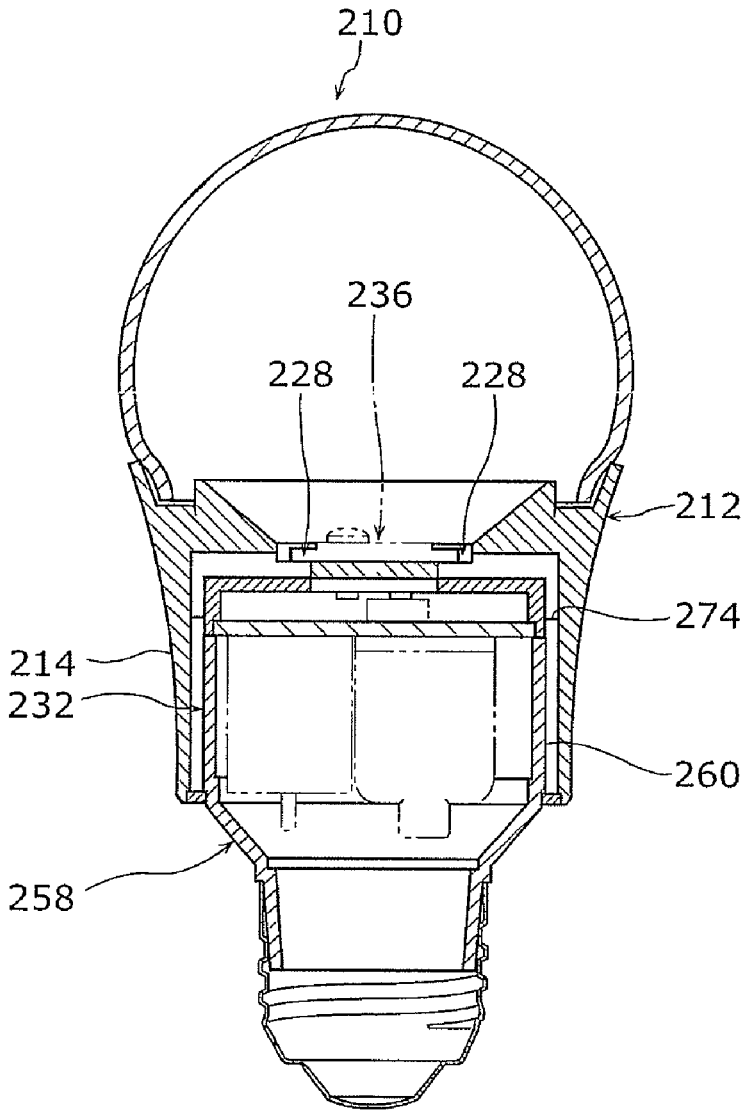

FIG. 12 is a cross sectional view of a conventional bulb LED lamp.

Figure 13:
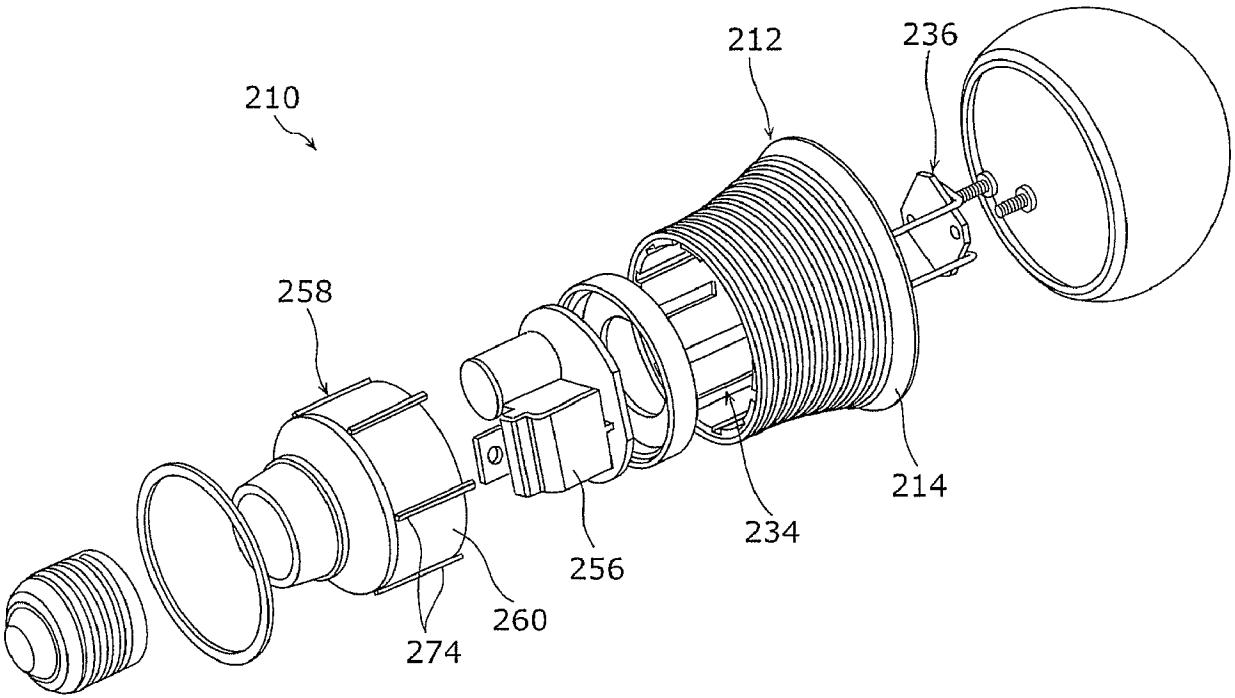

FIG. 13 is an exploded perspective view of a conventional bulb LED lamp.

DESCRIPTION OF EMBODIMENT

Hereinafter, a lamp and a lighting apparatus according to an embodiment of the present invention are described with reference to the drawings.

Figure 1:
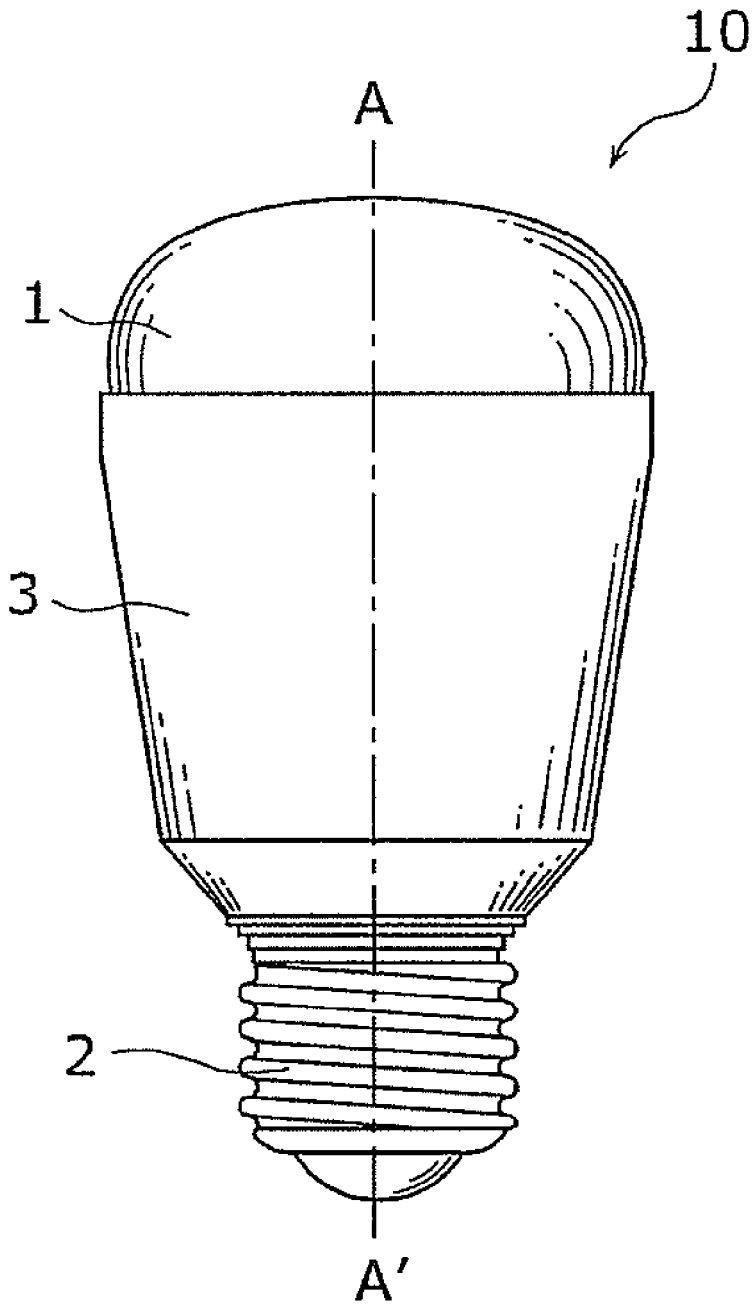
FIG. 1 is an external view of a lamp according to an embodiment of the present invention.
Figure 2:
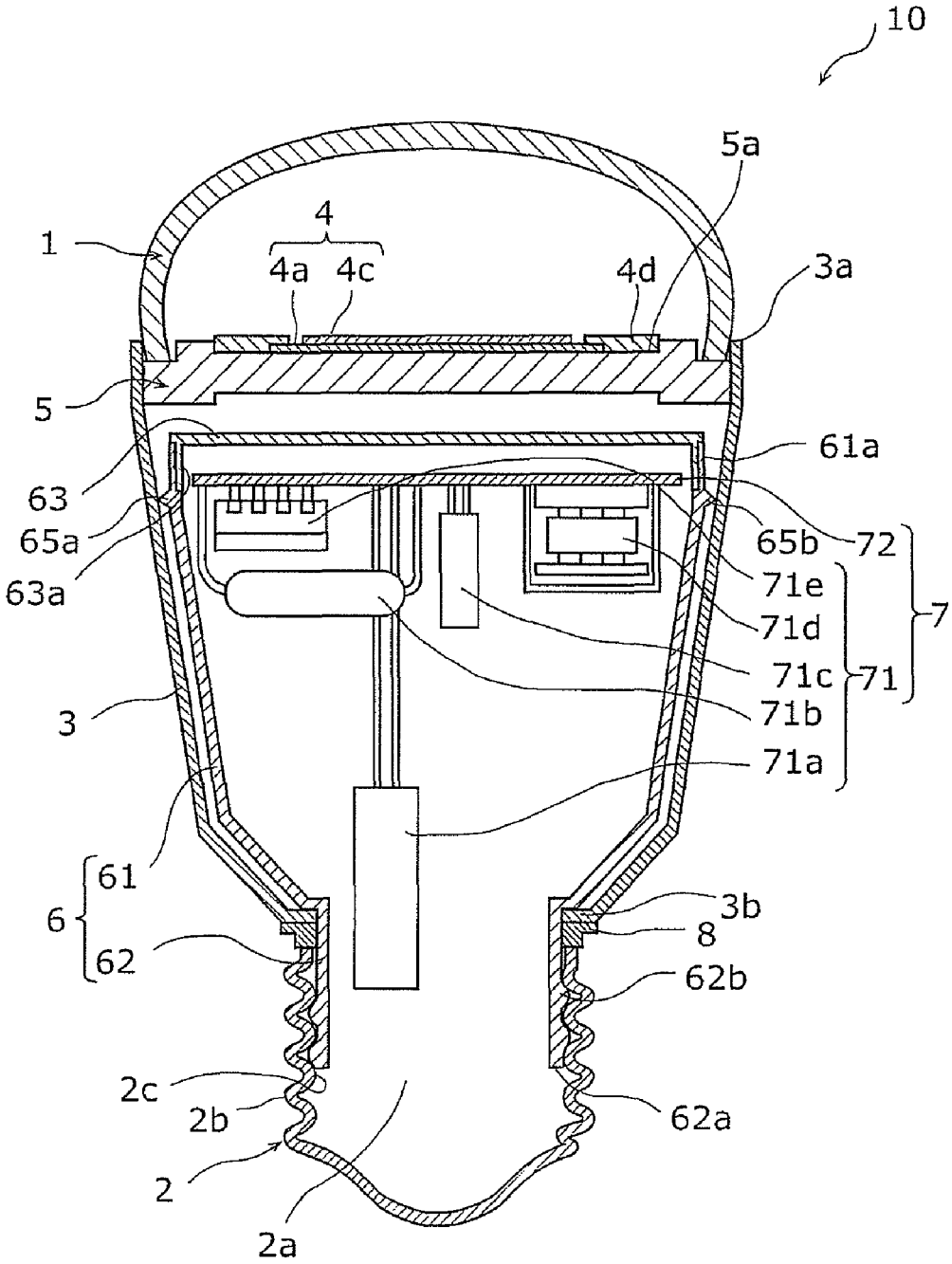
FIG. 2 is a cross sectional view of the lamp according to the embodiment of the present invention.
Figure 3:
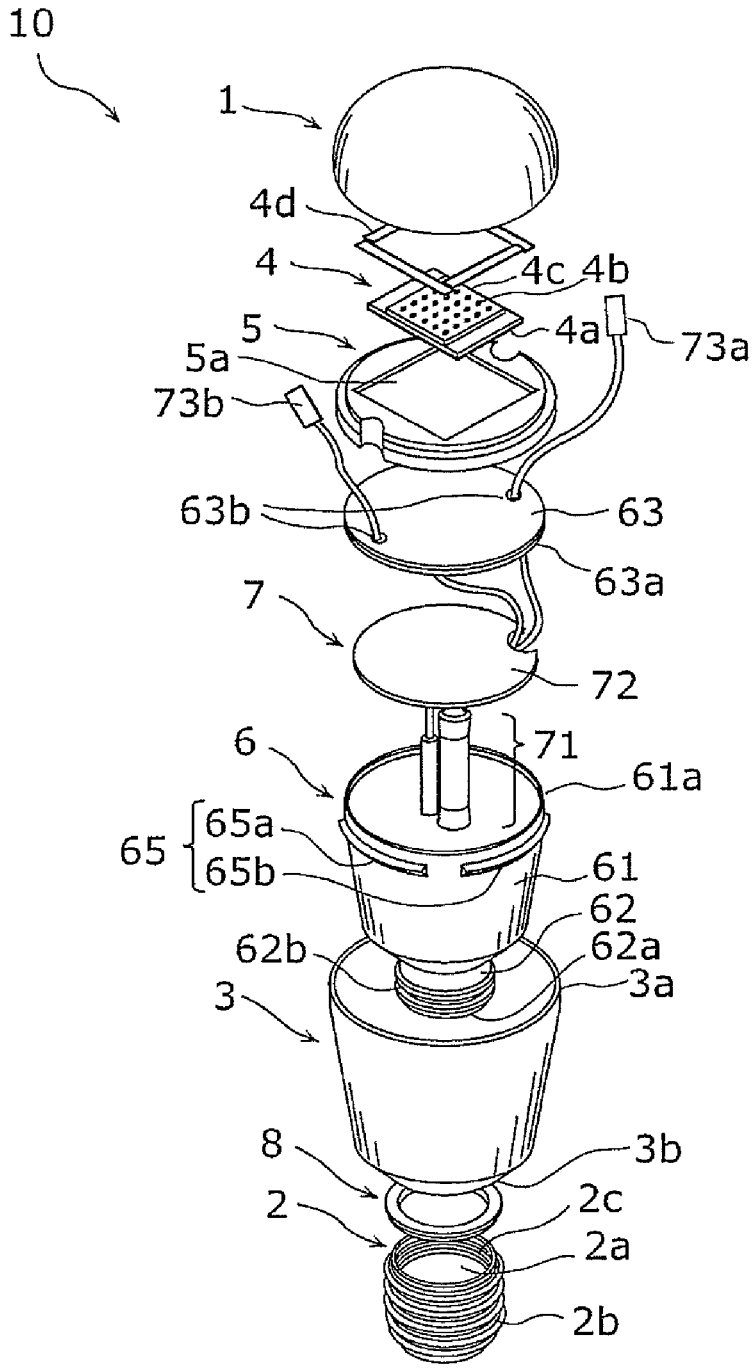
FIG. 3 is an exploded perspective view of the lamp according to the embodiment of the present invention.

FIG. 1 is a schematic view of the lamp 10 according to this embodiment of the present invention. FIG. 2 is a cross sectional view of the lamp 10 when the lamp 10 is cut on a surface including a center axis A to A' in FIG. 1. FIG. 3 is an exploded perspective view of the lamp 10.

This lamp 10 is a bulb LED lamp, and has a lamp cover including a globe 1, a base 2, and an outer casing 3 provided between the globe 1 and the base 2.

This globe 1 is a hemispherical transparent cover for emitting light from the LED module 4 to the outside. The LED module 4 is covered by the globe 1. In addition, the globe 1 is subjected to light dispersion processing such as grinding for dispersing light emitted from the LED module 4. The glove 1 has a shape tapered toward an opening, and an end portion of the opening of this globe 1 is positioned to abut an upper surface of a light source attachment member 5. The globe 1 is fixed on the outer casing 3 using a Silicone adhesive having a heat resistance. Here, the shape of the globe 1 is not limited to a hemisphere, and a rotation oval body and an oblate body are also possible. In addition, although the material of the globe 1 is a glass material in this embodiment, the material of the globe 1 is not limited to the glass material. The globe 1 may be formed using a synthesized resin or the like.

The base 2 is an electricity receiving part for receiving alternating electric power by two contact points. The electric power received by the base 2 is input to an electric power input unit of a circuit board 72 via a lead line (not shown). In addition, the base 2 is a tubular portion having a bottom surface and made of metal, and further has a hollow part 2*a* inside. In this embodiment, the base 2 is an E-shaped, and includes, on its outer surface, a screw part 2*b* for screwing into a socket (not shown) of the lighting apparatus. In addition, the base 2 includes, on its inner circumferential surface, a screw part 2*c* for screwing into a second casing part 62 of an inner casing 6 described later.

The outer casing 3 is an enclosure of a tubular heat transfer portion made of metal and including vertically arranged two openings of a first opening 3*a* which is the opening at the side of the globe 1 and a second opening 3*b* which is the opening at the side of the base 2. The diameter of the first opening 3*a* is larger than the diameter of the second opening 3*b*, and the outer casing 3 is a cylindrical portion having an inverse circular truncated cone shape as a whole. In this embodiment, the outer casing 3 is made using an aluminum alloy material. In addition, the surface of the outer casing 3 is subjected to anodic oxide coating, which increases the heat emission efficiency.

As shown in FIG. 2 and FIG. 3, the lamp 10 according to the embodiment of the present invention further includes an LED module 4, a light source attachment member 5, an inner casing 6, a lighting circuit 7, and an insulating ring 8.

The LED module 4 is an example of a light source composed of a semiconductor light-emitting device, and a light-emitting module (light-emitting unit) which emits predetermined light. The LED module 4 is composed of a rectangular ceramics board 4*a*, a plurality of LED chips 4*b* which is mounted on one side of the ceramics board 4*a*, and a sealing resin 4*c* for sealing these LED chips 4*b*. The sealing resin 4*c* includes predetermined phosphor particles dispersed inside. These phosphor particles convert the color of light emitted from these LED chips 4*b* to a desired color.

In this embodiment, blue LEDs which emit blue light are used as such LED chips 4*b* and yellow phosphor particles are used as such phosphor particles. In this case, the yellow phosphor particles emit yellow light excited by blue light from the blue LEDs, and white light generated through synthesis of the yellow light and the blue light from the blue LEDs is emitted from the LED module 4.

Here, in this embodiment, approximately 100 LED chips 4*b* are mounted in a matrix-shape arrangement on the ceramics board 4*a*. The LED module 4 is provided with two electrodes 73*a* and 73*b* connected to the lead line extending from an electric power output unit formed on the circuit board 72. The LED chips 4*b* emit light when direct electric power is supplied from these two electrodes 73*a* and 73*b* to the LED module 4.

The light source attachment member 5 is a holder (module plate) made using a metal board for disposing the LED module 4, and is formed to have a disc shape by aluminum die-casting. The light source attachment member 5 is a heat transfer portion which conducts heat generated from the LED module 4 to the outer casing 3. The light source attachment member 5 is mounted at the side of the first opening 3*a* of the outer casing 3 and is thermally connected to the light source of the LED module 4 and the outer casing 3. The light attachment member 5 abuts, at its side portion, an inner upper surface of the first opening 3*a* of the outer casing 3. In other words, the light source attachment member 5 is fit into the part which is of the outer casing 3 and at the side of the first opening 3*a*. In addition, the light source attachment member 5 includes a concave portion 5*a* which is formed in order to arrange the LED module 4. In this embodiment, the concave portion 5*a* is formed to have a rectangular shape similar to the shape of the ceramics board 4*a* of the LED module 4. The LED module 4 disposed on the concave portion 5*a* is held by a clasp 4*d*. Here, the light source attachment member 5 on which the light source is disposed and the outer casing 3 are independent members, but may be formed as an integrated component.

The inner casing 6 is a tubular portion made of resin for housing the lighting circuit 7 composed of a circuit device group 71, and includes the outer casing 3, a first casing part 61 which is a cylindrical portion having an inverse circular truncated cone shape which is approximately the same as the shape of the outer casing 3, and a second casing part 62 which is a cylindrical portion having approximately the same shape as the shape of the base 2. The inner casing 6 functions as an insulation casing for preventing contact between the circuit device group 71 and the outer casing 3 made of metal.

The first casing part 61 includes a first opening 61*a* which faces the side of the LED module 4 (opposite to the side of the second casing part 62). The first casing part 61 has, on the outer circumferential surface, a protrusion 65 which directly abuts the inner circumferential surface of the outer casing 3. The protrusion 65 takes roles for conducting heat generated by the circuit device group 71 to the outer casing 3 and fixing the inner casing 6 and the outer casing 3 with a certain gap (2 to 3 mm).

Here, the protrusion 65 is directly in contact with the inner circumferential surface of the outer casing 3. The protrusion 65 is directly in contact, at its end, with the inner circumferential surface of the outer casing 3 without being directly or indirectly in contact with any other structural elements. Here, it is only necessary that the inner casing 6 according to the present invention includes such a protrusion 65, and it is also good that the inner casing 6 further includes any other protrusion which is in contact with a structural element other than the outer casing 3.

The second casing part 62 includes the second opening 62*a* which faces the side of the base 2 (opposite to the side of the first casing part 61). The outer circumferential surface of the second casing part is formed to be in contact with the inner circumferential surface of the base 2. In this embodiment, a screw-fit part 62*b* for fitting with the base 2 is provided on the outer circumferential surface of the second casing part 62. With the screw-fit part 62*b*, the second casing part 62 is in contact with the base 2. In the case where the end portion of the protrusion 65 has a sharp shape as shown in FIG. 4, it is possible to increase the contact performance between the protrusion 65 and the outer casing 3 by pressing the end portion into the outer casing 3 so that the end portion is transformed. Alternatively, it is possible to make the sharp end portion of the protrusion 65 transformed and contact with the inner surface of the outer casing 3 by fitting the base 2 into the screw-fit part 62*b* of the inner casing 6.

In this embodiment, the first casing part 61, the protrusion 65, and the second casing part 62 which constitute the inner casing 6 are integrally formed by metal injection molding. This inner casing 6 (comprising the first casing part 61, the protrusion 65, and the second casing part 62) is molded by using, for example, Polybutyleneterephtalate (PBT) containing, at a percentage in a range from 15 to 40 percent, aluminum oxide whose particle diameter ranges from 1 μm to 10 μm. Here, it is also good to use, as a material for the inner casing 6, Poly Phenylene Sulfide Resin (PPS) containing, at a percentage in a range from 10 to 40 percent, zinc oxide (ZnO) whose particle diameter rages from 1 μm to 10 μm. To sum up, it is preferable that a resin having a high thermal conductivity should be used as a material for the inner casing 6.

The first opening 61*a* at the side of the light source attachment member 5 of the first casing part 61 includes a resin cap 63 attached thereto. This resin cap 63 seals the side of the light source attachment member 5 of the inner casing 6.

The resin cap 63 is approximately disc-shaped, and includes, on the outer circumferential end portion at its inner surface side, a circular protrusion 63*a* which protrudes in the depth direction of the inner casing. The protrusion 63*a* includes, on the inner circumferential surface, a plurality of engagement nails (not shown) formed to engage the circuit board. The protrusion 63*a* is configured to be fit into the end portion of the first opening 61*a* in the first casing part 61 of the inner casing 6. This resin cap 63 can be molded using the same material as the material of the inner casing 6. In addition, preferably, a resin having a high thermal conductivity should be used as a material for the resin cap 63. Here, the resin cap 63 includes a through hole 63*b* formed to allow passage of the lead line for supplying electric power to the LED module 4.

The lighting circuit 7 includes a circuit device group 71 which constitutes a circuit (power source circuit) for causing the LED chips 4*b* in the LED module 4 to emit light and a circuit board 72 on which the respective circuit devices of the circuit device group 71 are mounted.

The circuit device group 71 is composed of the circuit devices for generating electric power for causing the light source (LED module 4) to emit light, using the electric power received by the base 2. The circuit device group 71 converts alternating electric power received by the base 2 into direct electric power, and supplies the direct electric power to the LED chips 4*b* of the LED module 4 via the electrodes 73*a* and 73*b*. This circuit device group 71 includes a first capacitor device 71*a* which is an electrolytic capacitor (vertical capacitor), a second capacitor device 71*b* which is a ceramic capacitor (horizontal capacitor), a voltage conversion device 71*d* made of a coil, and a semiconductor device 71*e* which is an integrated circuit of an intelligent power device (IPD). Among the circuit devices constituting the circuit device group 71, circuit devices which particularly require a heat transfer measure are the components which generate a large amount of heat which are a capacitor device (especially the first capacitor device 71*a*) and a semiconductor device 71*e*.

A circuit board 72 is a disc-shaped printed board having the circuit device group 71 mounted on one of its surfaces. As described above, this circuit board 72 is held by the resin cap 63 having the engagement nails. Here, the circuit board 72 includes cutout portions. These cutout portions constitute a pathway for passing a lead line for supplying direct electric power to the LED module 4 to the surface opposite to the surface on which the circuit device group 71 is mounted.

The insulating ring 8 is for securely insulating the base 2 and the outer casing 3, and is disposed between the base 2 and the outer casing 3. The insulating ring 8 abuts, at the inner circumferential surface, the outer circumferential surface of the second casing part 62 of the inner casing 6. This insulating ring 8 is held by the opening end portion of the base 2 and the opening end portion of the outer casing 3 when the second casing part 62 of the inner casing 6 and the base 2 are screw-fit with each other. Here, preferably, the insulating ring 8 should be made of resin having a high thermal conductivity.

Next, a description is given of a unique structure of the lamp 10 configured as described above according to this embodiment.

(a) of FIG. 4 is a perspective view of the inner casing 6 of the lamp 10 shown in any one of FIG. 1 to FIG. 3. (b) of FIG. 4 is a plan view of the inner casing 6 when seen from the side of the LED module 4. This inner casing 6 includes, on the outer circumferential surface (more specifically, on the first casing part 61), a protrusion 65 which directly abuts the inner circumferential surface of the outer casing 3.

The protrusion 65 is composed of a plurality of (here, four) linear portions 65*a* to 65*d* extending in the circumferential direction of the outer circumferential surface of the inner casing 6. In this embodiment, these linear portions 65*a* to 65*d* are columnar portions which have a long horizontal side and have a triangle shape protruding from the outer circumferential surface of the inner casing 6 to the inner circumferential surface of the outer casing 3 (these linear portions 65*a* to 65*d* are columnar portions having a triangle-shaped cross section and are fixed along the circumferential direction of the inner casing 6). These linear portions 65*a* to 65*d* are formed by attaching convex portions having such a shape to the inner casing 6 or transforming the inner casing 6 such that the side surface of the inner casing 6 is partly protruded. These linear portions 65*a* to 65*d* are arranged along one of the circumferences on the outer circumferential surface of the inner casing 6 at a certain interval (for example, 5 mm to 10 mm). Here, in this DESCRIPTION, "horizontal" and "vertical" directions means the "horizontal" and "vertical" directions in the case where the drawings are seen from the front.

These linear portions 65*a* to 65*d* constituting the protrusion 65 increase the effect of transferring heat generated in the circuit device group 71 from the inner casing 6 to the outer casing 3. Since these linear portions 65*a* to 65*d* are arranged at the certain interval, gaps are secured between adjacent ones of the linear portions 65*a* to 65*d*. This prevents the space enclosed by the outer circumferential surface of the inner casing 6 and the inner circumferential surface of the outer casing 3 from being sealed by these linear portions 65*a* to 65*d*, and secures air convection in the space. Thereby, it is possible to prevent a local increase in the temperature of the lamp. Here, in the lamp 10 in this embodiment, heat generated from the LED module 4 is conducted to the outer casing 3. Thus, in the case where the amount of heat generated by the LED module 4 is smaller than the amount of heat generated by the circuit device group 71, heat generated inside the circuit device group 71 is efficiently transferred from the inner casing 6 to the outer casing 3 via the protrusion 65.

Here, it is only necessary that these linear portions 65*a* to 65*d* are formed integrally with the inner casing 6 so as to have a convex structure protruding toward the inner circumferential surface of the outer casing 3. Thus, these linear portions 65*a* to 65*d* may be columnar portions having a rectangular cross section or a circular cross section, instead of a triangle cross section. In addition, the number of linear portions arranged on one of the circumferences on the outer circumferential surface of the inner casing 6 is not limited to 4, any other numbers (such as 2, 3, 5, and numbers greater than 5) are also possible. Furthermore, these linear portions 65*a* to 65*d* may be arranged at the same interval or at different intervals.

Next, descriptions are given of other embodiments (variations) of the inner casing of a lamp according to the present invention.

(Variation 1)

First, a description is given of Variation 1 of the inner casing of the lamp according to the present invention.

In FIG. 5, (a) is a perspective view of the inner casing 16 according to Variation 1, and (b) is a plan view of the inner casing 16 when seen from the side of an LED module 4.

This inner casing 16 includes, on the outer circumferential surface (more specifically, at the first casing part 16*a*), a protrusion 17 which directly abuts the inner circumferential surface of the outer casing 3.

The protrusion 17 is composed of a plurality of (here, twelve) linear portions 17*a* to 17*h* extending in the circumferential direction of the outer circumferential surface of the inner casing 16. These linear portions 17*a* to 17*h* correspond to three sets of four linear portions 65*a* to 65*d* according to the firstly-described embodiment. The respective three sets of the four linear portions are provided on different circumferences on the outer circumferential surface of the inner casing 16. More specifically, among the twelve linear portions 17*a* to 17*h*, a first set of four of the linear portions 17*a* to 17*h* is arranged on one of the circumferences on the outer circumferential surface of the inner casing 16 at a certain interval; a second set of four of the linear portions 17*a* to 17*h* is arranged on another of the circumferences on the outer circumferential surface of the inner casing 16 at a certain interval; and a third set of the remaining four of the linear portions 17*a* to 17*h* is arranged on another of the circumferences on the outer circumferential surface of the inner casing 16 at a certain interval.

These linear portions 17*a* to 17*h* constituting the protrusion 17 increases the effect of transferring heat generated in the circuit device group 71 from the inner casing 16 to the outer casing 3. Since these linear portions 17*a* to 17*h* are arranged at the certain interval, gaps are secured between adjacent ones of the linear portions 17*a* to 17*h*. This prevents the space enclosed by the outer circumferential surface of the inner casing 16 and the inner circumferential surface of the outer casing 3 from being sealed by these linear portions 17*a* to 17*h*, and secures air convection in the space. Thereby, it is possible to prevent a local increase in the temperature of the lamp.

Furthermore, the linear portions 17*a* to 17*h* provided at the positions in the axis direction (the aforementioned central axis direction) of the outer circumferential surface of the inner casing 16 fix, to have a certain distance, the outer circumferential surface of the inner casing 16 and the inner circumferential surface of the outer casing 3. Thus, these linear portions increase the strength in the temporal fixing of the inner casing 16 in the outer casing 3 when the lamp components are assembled, increasing operability in the assembly process.

Here, it is only necessary that these linear portions 17*a* to 17*h* are formed integrally with the inner casing 16 so as to have a convex structure protruding toward the inner circumferential surface of the outer casing 3. Thus, these linear portions 17*a* to 17*h* may be columnar portions having a rectangular cross section or a circular cross section, instead of a triangle cross section. In addition, the number of linear portions arranged on one of the circumferences on the outer circumferential surface of the inner casing 16 is not limited to 4, any other numbers (such as 2, 3, 5, and numbers greater than 5) are also possible. Furthermore, these linear portions 17*a* to 17*h* may be arranged at the same interval or at different intervals.

(Variation 2)

First, a description is given of Variation 2 of the inner casing of a lamp according to the present invention.

In FIG. 6, (a) is a perspective view of the inner casing 26 according to Variation 2, and (b) is a plan view of the inner casing 26 when seen from the side of an LED module 4.

This inner casing 26 includes, on the outer circumferential surface (more specifically, at the first casing part 26*a*), a protrusion 27 which directly abuts the inner circumferential surface of the outer casing 3.

The protrusion 27 is composed of a plurality of (here, three) linear portions 27*a* to 27*c* extending in the circumferential direction of the outer circumferential surface of the inner casing 26. These linear portions 27*a* to 27*c* are formed on different ones (here, three different circumferences) of circumferences on the outer circumferential surface of the inner casing 26, so as to enclose the entire one of the circumferences on the outer circumferential surface of the inner casing 26. In this variation, these linear portions 27*a* to 27*c* are columnar portions which have a long horizontal side and protrude from the outer circumferential surface of the inner casing 26 to the inner circumferential surface of the outer casing 3 (these linear portions 27*a* to 27*c* are columnar portions having a rectangular cross section and are fixed along the circumferential direction of the inner casing 26). These linear portions 27*a* to 27*c* are formed by attaching convex portions having such a shape to the inner casing 26 or transforming the inner casing 26 such that the side surface of the inner casing 26 is partly protruded.

These linear portions 27*a* to 27*c* include (i) the linear portions 27*b* and 27*c* which are provided on one of the circumferences which is closer to a second opening 62*a* than to a first opening 61*a* on the outer circumferential surface of the inner casing 26 and (ii) the linear portion 27*a* which is provided on one of the circumferences which is closer to the first opening 61*a* than to the second opening 62*a*. The linear portion 27*a* located above the linear portions 27*b* and 27*c* exerts a function of positioning the outer casing 3 and the inner casing 26 with secured gaps and a function of transferring heat from the circuit device group 71. On the other hand, the linear portions 27*b* and 27*c* located below the linear portion 27*a* are positioned on the circumference which is closer to the circuit device (for example, the first capacitor device 71*a*) which generates a particularly large amount of heat on the outer circumferential surface of the inner casing 26, and dedicatedly exerts the heat transfer function. In this embodiment, the number of the linear portion 27*a* located above (here, one) is designed to be smaller than the number of the linear portions 27*b* and 27*c* located below (here, two) with consideration that the upper part of the outer circumferential surface of the inner casing 26 is closer to the LED module 4 having a high temperature and thus provides a low heat transfer effect, and that the lower part is closer to the base 2 though which heat is easily conducted to the outside and thus provides a high heat transfer effect.

These linear portions 27*a* to 27*c* increase the effect of transferring heat generated in the circuit device group 71 from the inner casing 26 to the outer casing 3.

Furthermore, the linear portions 27*a* to 27*c* provided at the positions in the axis direction of the outer circumferential surface of the inner casing 26 fix, to have a certain distance, the outer circumferential surface of the inner casing 26 and the inner circumferential surface of the outer casing 3. Thus, these linear portions increase the strength in the temporal fixing of the inner casing 26 in the outer casing 3 when the lamp components are assembled, increasing operability in the assembly process.

Here, it is only necessary that these linear portions 27*a* to 27*c* are formed integrally with the inner casing 26 so as to have a convex structure protruding toward the inner circumferential surface of the outer casing 3. Thus, these linear portions 27*a* to 27*c* may be columnar portions having a triangle cross section or a circular cross section, instead of a rectangular cross section. In addition, the number of linear portions arranged on one of the circumferences on the outer circumferential surface of the inner casing 26 is not limited to 3, any other numbers (such as 2, 4 and numbers greater than 4) are also possible.

(Variation 3)

First, a description is given of Variation 3 of the inner casing of a lamp according to the present invention.

In FIG. 7, (a) is a perspective view of the inner casing 36 according to Variation 3, and (b) is a plan view of the inner casing 36 when seen from the side of an LED module 4.

This inner casing 36 includes, on the outer circumferential surface (more specifically, at the first casing part 36*a*), a protrusion 37 which directly abuts the inner circumferential surface of the outer casing 3.

The protrusion 37 is composed of a plurality of (here, four) linear portions 37*a* to 37*d* extending in the circumferential direction of the outer circumferential surface of the inner casing 36. In this variation, these linear portions 37*a* to 37*d* are protrusions having a long vertical side and having a triangle shape protruding from the outer circumferential surface of the inner casing 36 to the inner circumferential surface of the outer casing 3 (these linear portions 37*a* to 37*d* are triangular-pyramid portions having a triangle-shaped cross section which decreases toward the bottom). These linear portions 37*a* to 37*d* are formed by attaching convex portions having such a shape to the inner casing 36 or transforming the inner casing 36 such that the side surface of the inner casing 36 is partly protruded. These linear portions 37*a* to 37*d* are arranged on the outer circumferential surface on the inner casing 36 at a certain interval (here, at positions determined by segmenting, in units of 90 degrees, the circumference of the outer circumferential surface of the inner casing 36).

These linear portions 37*a* to 37*d* are provided in an area which is on the outer circumferential surface of the inner casing 36 and covers the circuit device group 71, that is, the area in which the circuit device group 71 is present in the axis (vertical) direction on the outer circumferential surface of the inner casing 36.

These linear portions 37*a* to 37*d* which constitute the protrusion 37 are provided at the positions (in the axis direction) close to the circuit device which generates heat, increasing the heat transfer effect. Furthermore, the linear portions 37*a* to 37*d* provided at the positions in the axis direction of the outer circumferential surface of the inner casing 36 fix, to have a certain distance, the outer circumferential surface of the inner casing 36 and the inner circumferential surface of the outer casing 3. Thus, these linear portions increase the strength in the temporal fixing of the inner casing 36 in the outer casing 3 when the lamp components are assembled, increasing operability in the assembly process.

Here, it is only necessary that these linear portions 37*a* to 37*d* are formed integrally with the inner casing 36 so as to have a convex structure protruding toward the inner circumferential surface of the outer casing 3. Thus, these linear portions 37*a* to 37*d* may be protrusions having a rectangular or circular cross section, instead of a triangle cross section. In addition, the number of linear portions arranged on one of the circumferences on the outer circumferential surface of the inner casing 36 is not limited to 4, any other numbers (such as 2, 3, 5 and numbers greater than 5) are also possible. Furthermore, these linear portions 37*a* to 37*d* may be arranged at the same interval or at different intervals.

(Variation 4)

First, a description is given of Variation 4 of the inner casing of a lamp according to the present invention.

In FIG. 8, (a) is a perspective view of the inner casing 46 according to Variation 1, and (b) is a plan view of the inner casing 46 when seen from the side of an LED module 4.

This inner casing 46 includes, on the outer circumferential surface (more specifically, at the first casing part 46*a*), a protrusion 47 which directly abuts the inner circumferential surface of the outer casing 3.

The protrusion 47 is composed of a plurality of linear portions (fins) 47*a* to 47*c* extending in the axis (vertical) direction of the outer circumferential surface of the inner casing 46. In this variation, these linear portions 47*a* to 47*c* are protrusions having a long vertical side and having a rectangle shape protruding from the outer circumferential surface of the inner casing 46 to the inner circumferential surface of the outer casing 3 (these linear portions 47*a* to 47*c* are square-pyramid portions having a rectangular cross section which decreases toward the bottom). These linear portions 47*a* to 47*c* are formed by attaching convex portions having such a shape to the inner casing 46 or transforming the inner casing 46 such that the side surface of the inner casing 46 is partly protruded. These linear portions 47*a* to 47*c* compose heat transfer fins and are arranged on the outer circumferential surface of the inner casing 46 at a certain interval such that convexes and concaves alternately appear in the circumferential direction of the outer circumferential surface of the inner casing 46.

These linear portions 47*a* to 47*c* are provided in an area which is on the outer circumferential surface of the inner casing 46 and covers the circuit device group 71, that is, the area in which the circuit device group 71 is present in the axis (vertical) direction on the outer circumferential surface of the inner casing 46.

These linear portions 47*a* to 47*c* which constitute the protrusion 47 are provided at the positions (in the axis direction) close to the circuit device which generates heat, increasing the heat transfer effect. Furthermore, the linear portions 47*a* to 47*c* provided at the positions in the axis direction of the outer circumferential surface of the inner casing 46 fix, to have a certain distance, the outer circumferential surface of the inner casing 46 and the inner circumferential surface of the outer casing 3. Thus, these linear portions increase the strength in the temporal fixing of the inner casing 46 in the outer casing 3 when the lamp components are assembled, increasing operability in the assembly process.

Here, it is only necessary that these linear portions 47*a* to 47*c* are formed integrally with the inner casing 46 so as to have a convex structure protruding toward the inner circumferential surface of the outer casing 3. Thus, these linear portions 47*a* to 47*c* may be protrusions having a triangular cross section or a circular cross section, instead of a rectangular cross section. There is no need to provide such a protrusion 47 on the entire circumference among circumferences in the circumferential direction of the outer circumferential surface of the inner casing 46. For example, it is also good to provide such a protrusion 47 at a position at which the temperature is increased by the circuit device group 71.

(Variation 5)

Next, a description is given of Variation 5 of the inner casing of a lamp according to the present invention.

In FIG. 9, (a) is a perspective view of the inner casing 56 according to Variation 5, and (b) is a plan view of the inner casing 56 when seen from the side of an LED module 4.

This inner casing 56 includes, on the outer circumferential surface (more specifically, at the first casing part 56*a*), a protrusion 57 which directly abuts the inner circumferential surface of the outer casing 3.

The protrusion 57 is composed of a plurality of (here, four) columnar portions 57*a* to 57*d* extending in the circumferential direction of the outer circumferential surface of the inner casing 56. In this variation, these columnar portions 57*a* to 57*d* are rectangle-column portions which protrude out in the direction from the outer circumferential surface of the inner casing 56 to the inner circumferential surface of the outer casing 3. These columnar portions 57*a* to 57 are formed by attaching convex portions having such a shape to the inner casing 56 or transforming the inner casing 56 such that the side surface of the inner casing 56 is partly protruded. These columnar portions 57*a* to 57*d* are arranged on the outer circumferential surface on the inner casing 56 at a certain interval (here, at positions determined by segmenting, in units of 90 degrees, the circumference of the outer circumferential surface of the inner casing 56).

These columnar portions 57*a* to 57*d* constituting the protrusion 57 increase the effect of transferring heat generated in the circuit device group 71 from the inner casing 56 to the outer casing 3. Since these columnar portions 57*a* to 57*d* are arranged at the certain interval, gaps are secured between adjacent ones of the columnar portions 57*a* to 57*d*. This prevents the space enclosed by the outer circumferential surface of the inner casing 56 and the inner circumferential surface of the outer casing 3 from being sealed by these columnar portions 57*a* to 57*d*, and secures air convection in the space. Thereby, it is possible to prevent a local increase in the temperature of the lamp.

Furthermore, the columnar portions 57*a* to 57*d* provided at the positions in the axis direction of the outer circumferential surface of the inner casing 56 fix, to have a certain distance, the outer circumferential surface of the inner casing 56 and the inner circumferential surface of the outer casing 3. Thus, these columnar portions increase the strength in the temporal fixing of the inner casing 56 in the outer casing 3 when the lamp components are assembled, increasing operability in the assembly process.

Here, it is only necessary that these columnar portions 57*a* to 57*d* are formed integrally with the inner casing 56 and have a convex structure which protrudes toward the inner circumferential surface of the outer casing 3. These columnar portions 57*a* to 57*d* may be triangular-column portions or circular-column portions, instead of rectangular-column portions which protrude out toward the inner circumferential surface of the outer casing 3. In addition, the number of columnar portions arranged on one of the circumferences on the outer circumferential surface of the inner casing 56 is not limited to 4, any other numbers (such as 2, 3, 5 and numbers greater than 5) are also possible. Furthermore, these columnar portions 57*a* to 57*d* may be arranged at the same interval or at different intervals.

(Other Variations)

Next, descriptions are given of Variations of inner casings of lamps according to the present invention.

In FIG. 10, (a) is a perspective view of an inner casing 66 according to one of the variations. This inner casing 66 includes, on the outer circumferential surface (more specifically, at the first casing part 66*a*), a protrusion 67 which directly abuts the inner circumferential surface of the outer casing 3. This protrusion 67 includes a linear portion 67*a* having the same structure as that of the linear portion 27*a* according to Variation 2 and columnar portions 67*b* to 67*d* having the same structure as those of the columnar portions 57*a* to 57*c* according to Variation 5.

Here, the columnar portions 67*b* to 67*d* are not arranged evenly in the circumferential direction on the outer circumferential surface of the inner casing 56, but only at the positions corresponding to circuit devices (for example, the first capacitor device 71*a*) which generate a particularly large amount of heat in the circuit device group 71. In this way, it is possible to provide a higher heat transfer effect for the circuit devices which generate heat more easily.

In FIG. 10, (b) is a perspective view of an inner casing 68 according to one of the variations. This inner casing 68 includes, on the outer circumferential surface (more specifically, at the first casing part 68*a*), a protrusion 69 which directly abuts the inner circumferential surface of the outer casing 3. Here, the protrusion 69 includes a circular portion 69*a* having the same shape as that of the linear portion 67*a* shown in (a) of FIG. 10 and convex portions 69*b* to 69*d* arranged at the same positions as those of the columnar portions 67*b* to 67*d* shown in (a) of FIG. 10.

Here, the circular portion 69*a* has the same shape as that of the linear portion 67*a* shown in (a) of FIG. 10, but is formed independently from the inner casing 68. Thus, the circular portion 69*a* is different from the linear portion 67*a* in the point of functioning as the protrusion of the inner casing 68 when fit into the outer circumference of the inner casing 68. In this way, it is possible to modify a conventional lamp having an inner casing without any protrusion into a lamp having an excellent heat transfer effect according to the present invention by adding a protrusion (the circular portion 69*a*) independent from the inner casing to the conventional lamp.

The attachment positions for the convexes 69*b* to 69*d* are the same as those of the columnar portions 67*b* to 67*d* shown in (a) of FIG. 10. However, unlike the case of the columnar portions 67*b* to 67*d*, each of these convexes 69*b* to 69*d* is formed by cutting and turning up outward a part of the side surface of the inner casing 68 such that the part corresponds to a rectangle (specifically, three sides of the rectangle are cut and then turned up outward). In this way, the part generated by cutting and turning up outward the part to transform the inner casing 68 and serving as the part of the protrusion 69 becomes in contact with the inner circumferential surface of the outer casing 3, increasing the closeness and heat transfer effect. Furthermore, the part increases the strength of the temporal fixing of the inner casing 68 in the outer casing 3 when the components are assembled and operability in the assembly process.

Here, as for the direction for cutting and turning up outward the part of the side surface of the inner casing 68, the lower side of the part (a rectangular portion) of the inner casing 68, using the upper side as an axis, like each of the convex portions 69*b* to 69*d* shown in (b) of FIG. 10. However, it is also good to perform, in the opposite direction, such cutting and turning up outward of the upper side of the part (a rectangular portion) of the inner casing 68 using the lower side as an axis, like each of the convex portions 69*e* to 69*g* shown in (c) of FIG. 10. The inner casing 68 including the convex portions 69*e* to 69*g* arranged in the direction is easily inserted into the outer casing 3, and increases the contact with the outer casing by the flexibility of the convex portions 69*e* to 69*g*.

The above embodiment and variations of the present invention particularly describe lamps. The lamps according to the embodiment and variations are applicable to lighting apparatuses. Hereinafter, a lighting apparatus according to the present invention is described with reference to FIG. 11. FIG. 11 is a schematic cross sectional view of a lighting apparatus 100 according to the present invention.

The lighting apparatus 100 according to the present invention is mounted for use on a ceiling 200 in a room, and includes a lamp 110 and a lighting tool 120 as shown in FIG. 11. As the lamp 110, the lamp according to any one of the embodiment and variations can be used.

The lighting tool 120 is for turning OFF and ON the lamp 110, and includes a tool body 121 attached to the ceiling 200 and a lamp cover 122 which covers the lamp 110.

The tool body 121 includes a socket 121*a* which is screwed to the base 111 of the lamp 110 and through which predetermined electric power is supplied to the lamp 110.

The lighting apparatus 100 described here is a mere example. Any other lighting apparatus is possible as long as the lighting apparatus includes the socket 121*a* for screwing of the base 111 of the lamp 110. The lighting apparatus 100 shown in FIG. 11 includes a single lamp. However, the lighting apparatus 100 may include a plurality of lamps, for example, two or more lamps.

The lamps and lighting apparatuses according to the present invention have been described above based on the embodiment and variations. However, the present invention is not limited to the above-described embodiment and variations. Those skilled in the art will readily appreciate that many modifications are possible in the exemplary embodiments and other embodiments are possible by arbitrarily combining the structural elements of the embodiments without materially departing from the novel teachings and advantageous effects of the present invention. Accordingly, all of the modifications and other embodiments are intended to be included within the scope of the present invention.

For example, it is possible to provide, as the protrusion provided on the inner casing of the lamp according to the present invention, the linear portions 65*a* to 65*d* according to the embodiment and the linear portions 37*a* to 37*d* in Variation 3. More specifically, it is possible to arrange the linear portions 65*a* to 65*d* in the circumferential direction in the upper space (a position close to the LED module 4) of the inner casing, for the purposes of positioning and heat transfer, and to arrange the linear portions 37*a* to 37*d* in the axis (vertical) direction in the lower space (a position inside of which the circuit device group is present) of the inner casing, for the dedicated purpose of exerting the heat transfer function. This makes it possible to increase the fixing performance of the inner casing and the heat transfer effect.

INDUSTRIAL APPLICABILITY

The present invention is applicable to LED lamps and lighting apparatuses, and the like which have a semiconductor light-emitting device such as an LED, and particularly to a small bulb LED lamp and a lighting apparatus using such an LED lamp that is difficult to be designed to transfer heat because of its size and structure.

REFERENCE SIGNS LIST

1 Globe
2, 111 Base
2*a* Hollow part
2*b* Screw part

2*c* Screw part
3 Outer casing
3*a* First opening
3*b* Second opening
4 LED module
4*a* Ceramics substrate
4*b* LED chip
4*c* Sealing resin
4*d* Clasp
5 Light source attachment member
5*a* Concave portion
6, 16, 26, 36, 46, 56, 66, 68 Inner casing
7 lighting circuit
8 Insulating ring
10, 110 Lamp
16*a*, 26*a*, 36*a*, 46*a*, 56*a*, 61, 66*a*, 68*a* First casing part
17, 27, 37, 47, 57, 65, 67, 69 Protrusion
17-17*h*, 27*a*-27*c*, 37*a*-37*d*, 47*a*-47*c*, 65*a*-65*d*, 67*a* Linear portion
57*a*-57*d*, 67*b*-67*d* Columnar portion
61*a* First opening
62 Second casing part
62*a* Second opening
62*b* Screw-fit part
63 Resin cap
63*a* Ejection part
63*b* Through hole
69*a* Circular portion
69*b*-69*g* Convex portion
71 Group of circuit elements
71*a*, 71*b* Capacitance element
71*c* Resistance element
71*d* Voltage conversion element
71*e* Semiconductor device
72 Circuit board
73*a*, 73*b* Electrode
100 Lighting apparatus
120 Lighting tool
121 Tool body
121*a* Socket
122 Lamp cover
200 Ceiling

The invention claimed is:

1. A lamp comprising:

a light source including a semiconductor light-emitting device;

a base through which electric power is received;

a lighting circuit including a circuit device which generates electric power for causing said light source to emit light, using the electric power received through said base;

an inner casing which is a tubular portion made of resin for housing said lighting circuit; and an outer casing which is a tubular portion for housing said inner casing, wherein said outer casing is a cylindrical portion having an inverse circular truncated cone shape and having an inner diameter and an outer diameter both decreasing toward said base, wherein said inner casing has a protrusion on an outer circumferential surface of said inner casing, said protrusion directly abutting an inner circumferential surface of said outer casing, and said protrusion positionally corresponding to a circuit device which is predetermined as generating a large amount of heat from among circuit devices included in said lighting circuit, and said protrusion has a linear structure extending in a circumferential direction of the outer circumferential surface of said inner casing.

2. The lamp according to claim 1, wherein said protrusion has a plurality of linear portions each having the linear structure.

3. The lamp according to claim 2, wherein said linear portions are arranged, at a certain interval, on a circumference on the outer circumferential surface of said inner casing.

4. The lamp according to claim 2, wherein said linear portions are provided on mutually different circumferences on the outer circumferential surface of said inner casing.

5. The lamp according to claim 2, wherein said inner casing includes a first opening which is open toward said light source and a second opening which is positioned opposite to said first opening, and said linear portions include: a linear portion which is provided on a circumference that is closer to said second opening than to said first opening on the outer circumferential surface of said inner casing; and a linear portion which is provided on a circumference that is closer to said first opening than to said second opening on the outer circumferential surface of said inner casing.

6. The lamp according to claim 2, wherein at least one of said linear portions is provided along an entire circumference on the outer circumferential surface of said inner casing.

7. The lamp according to claim 1, wherein said protrusion includes a linear structure extending in an axis direction of said tubular portion in the outer circumferential surface of said inner casing.

8. The lamp according to claim 7, wherein said protrusion includes a plurality of linear portions each having the linear structure.

9. The lamp according to claim 1, wherein said protrusion includes a plurality of columnar portions each having a columnar structure which protrudes out from the outer circumferential surface of said inner casing toward an inner circumferential surface of said outer casing.

10. The lamp according to claim 9, wherein said columnar portions are arranged on a circumference on the outer circumferential surface of said inner casing.

11. The lamp according to claim 1, wherein said protrusion is provided at least in an area which covers said circuit device and is on the outer circumferential surface of said inner casing.

12. The lamp according to claim 1, wherein said protrusion is formed integrally with said inner casing.

13. The lamp according to claim 1, wherein said protrusion is formed independently from said inner casing.

14. The lamp according to claim 13, wherein said protrusion has a circular structure which encloses a whole circumference on the outer circumferential surface of said inner casing, and functions as said protrusion when fit into said inner casing.

15. The lamp according to claim 1, wherein said protrusion is formed by cutting and turning up outward a part of a side surface of said inner casing.

16. A lighting apparatus, comprising:

a lamp comprising:

a light source including a semiconductor light-emitting device;

a base through which electric power is received;

a lighting circuit including a circuit device which generates electric power for causing said light source to emit light, using the electric power received through said base;

an inner casing which is a tubular portion made of resin for housing said lighting circuit; and an outer casing which is a tubular portion for housing said inner casing, wherein said outer casing is a cylindrical portion having an inverse circular truncated cone shape and having an inner diameter and an outer diameter both decreasing toward said base, wherein said inner casing has a protrusion on an outer circumferential surface of said inner casing, said protrusion directly abutting an inner circumferential surface of said outer casing, and said protrusion positionally corresponding to a circuit device which is predetermined as generating a large amount of heat from among circuit devices included in said lighting circuit, and said protrusion has a linear structure extending in a circumferential direction of the outer circumferential surface of said inner casing.

* * * * *